US006209137B1

(12) United States Patent
Wallick

(10) Patent No.: US 6,209,137 B1
(45) Date of Patent: Apr. 3, 2001

(54) VIDEO GAME GLOVE

(76) Inventor: Bernadette Wallick, 40 Bay Shore Ave. #5, Long Beach, CA (US) 90803

( * ) Notice: Subject to any disclaimer, the term of this patent is extended or adjusted under 35 U.S.C. 154(b) by 0 days.

(21) Appl. No.: 09/439,336

(22) Filed: Nov. 12, 1999

(51) Int. Cl.[7] ..... A41D 19/00; A63B 71/14
(52) U.S. Cl. ..... 2/161.1; 2/159; 2/163
(58) Field of Search ..... 2/455, 16, 21, 2/159, 160, 161.1, 161.4, 161.5, 163, 167, 170

(56) References Cited

U.S. PATENT DOCUMENTS

| | | | | |
|---|---|---|---|---|
| D. 243,292 | | 2/1977 | Koehler . | |
| 2,447,328 | | 8/1948 | Gerrits . | |
| 3,649,967 | * | 3/1972 | Millman | 2/161.3 |
| 4,064,563 | * | 12/1977 | Stokes | 2/161.1 |
| 4,095,292 | * | 6/1978 | Klein | 2/161.2 |
| 4,103,362 | * | 8/1978 | Blakeman . | |
| 4,519,097 | * | 5/1985 | Chappell, Jr. et al. . | |
| 4,573,220 | * | 3/1986 | Baker . | |
| 4,894,866 | * | 1/1990 | Walker . | |
| 5,390,372 | * | 2/1995 | Hashimoto et al. | 2/161.2 |
| 5,511,248 | * | 4/1996 | Widdemer | 2/161.3 |
| 6,009,557 | * | 1/2000 | Witta | 2/159 |
| 6,035,443 | * | 3/2000 | Green | 2/161.2 |

* cited by examiner

*Primary Examiner*—John J. Calvert
*Assistant Examiner*—Robert H. Moromoto, Jr.

(57) ABSTRACT

A video game glove for protecting the index finger, thumb and palm of a video game player. The video game glove includes a panel having a top surface, a bottom surface, a palm portion, and a back portion. The panel is adapted to wrap around the edge of a person's hand such that the palm portion covers the palm of the person and the back portion covers the back of the palm of the person. A pair of finger stalls receive an index finger and a thumb. The finger stalls each have a front portion and a back portion, wherein each of the front portions are coupled to the palm portion of the panel and the back portions are coupled to the back portion. A tab portion extends from the palm portion such that the tab may be wrapped about an open edge of the hand. A securing means releasably secures the tab portion to the back portion of the panel.

6 Claims, 1 Drawing Sheet

FIG 1
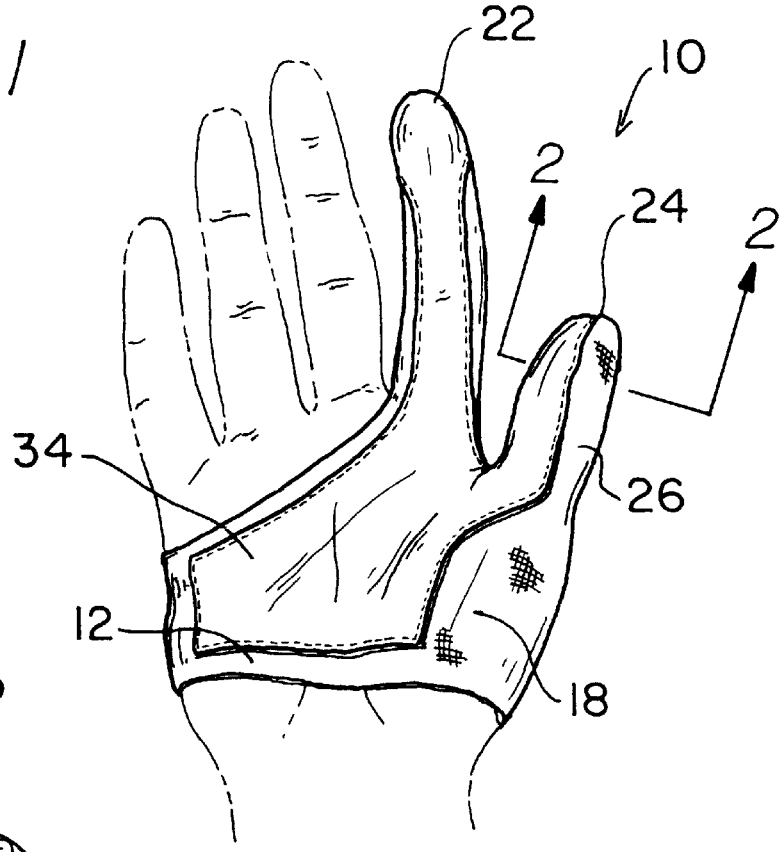
FIG 2
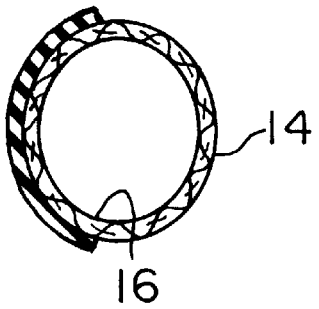
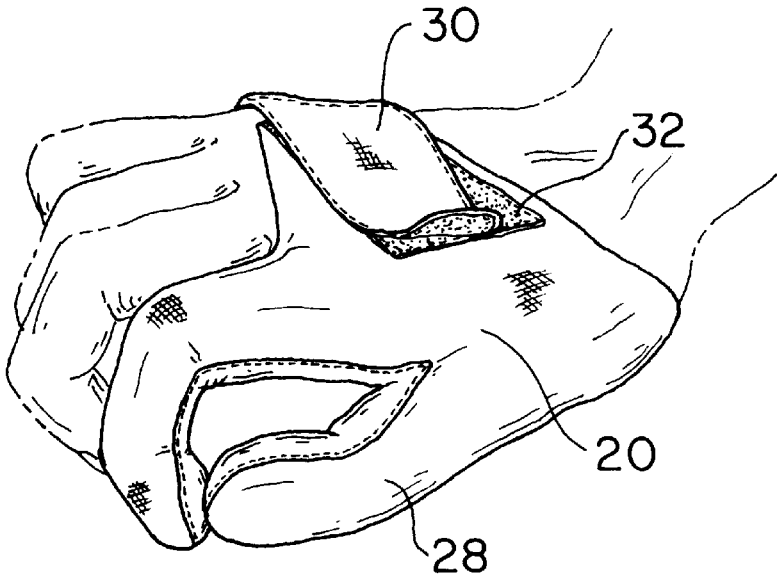
FIG 3

VIDEO GAME GLOVE

BACKGROUND OF THE INVENTION

1. Field of the Invention

The present invention relates to protective gloves and more particularly pertains to a new video game glove for protecting the index finger, thumb and palm of a vidoe game player.

2. Description of the Prior Art

The use of protective gloves is known in the prior art. More specifically, protective gloves heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,894,866; U.S. Pat. No. 4,519,097; U.S. Pat. Des. No. 243,292; U.S. Pat. No. 2,447,328; U.S. Pat. No. 4,103,362; and U.S. Pat. No. 4,573,220.

While these devices fulfill their respective, particular objectives and requirements, the aforementioned patents do not disclose a new video game glove. The inventive device includes a panel having a top surface, a bottom surface, a palm portion, and a back portion. The panel is adapted to wrap around the edge of a person's hand such that the palm portion covers the palm of the person and the back portion covers the back of the palm of the person. A pair of finger stalls receive an index finger and a thumb. The finger stalls each have a front portion and a back portion, wherein each of the front portions are coupled to the palm portion of the panel and the back portions are coupled to the back portion. A tab portion extends from the palm portion such that the tab may be wrapped about an open edge of the hand. A securing means releasably secures the tab portion to the back portion of the panel.

In these respects, the video game glove according to the present invention substantially departs from the conventional concepts and designs of the prior art, and in so doing provides an apparatus primarily developed for the purpose of protecting the index finger, thumb and palm of a vidoe, game player.

SUMMARY OF THE INVENTION

In view of the foregoing disadvantages inherent in the known types of protective gloves now present in the prior art, the present invention provides a new video game glove construction wherein the same can be utilized for protecting the index finger, thumb and palm of a vidoe game player.

The general purpose of the present invention, which will be described subsequently in greater detail, is to provide a new video game glove apparatus and method which has many of the advantages of the protective gloves mentioned heretofore and many novel features that result in a new video game glove which is not anticipated, rendered obvious, suggested, or even implied by any of the prior art protective gloves, either alone or in any combination thereof.

To attain this, the present invention generally comprises a panel having a top surface, a bottom surface, a palm portion, and a back portion. The panel is adapted to wrap around the edge of a person's hand such that the palm portion covers the palm of the person and the back portion covers the back of the palm of the person. A pair of finger stalls receive an index finger and a thumb. The finger stalls each have a front portion and a back portion, wherein each of the front portions are coupled to the palm portion of the panel and the back portions are coupled to the back portion. A tab portion extends from the palm portion such that the tab may be wrapped about an open edge of the hand. A securing means releasably secures the tab portion to the back portion of the panel.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new video game glove apparatus and method which has many of the advantages of the protective gloves mentioned heretofore and many novel features that result in a new video game glove which is not anticipated, rendered obvious, suggested, or even implied by any of the prior art protective gloves, either alone or in any combination thereof.

It is another object of the present invention to provide a new video game glove which may be easily and efficiently manufactured and marketed.

It is a further object of the present invention to provide a new video game glove which is of a durable and reliable construction.

An even further object of the present invention is to provide a new video game glove which is susceptible of a low cost of manufacture with regard to both materials and labor, and which accordingly is then susceptible of low prices of sale to the consuming public, thereby making such video game glove economically available to the buying public.

Still yet another object of the present invention is to provide a new video game glove which provides in the apparatuses and methods of the prior art some of the advantages thereof, while simultaneously overcoming some of the disadvantages normally associated therewith.

Still another object of the present invention is to provide a new video game glove for protecting the index finger, thumb and palm of a vidoe game player.

Yet another object of the present invention is to provide a new video game glove which includes a panel having a top surface, a bottom surface, a palm portion, and a back portion. The panel is adapted to wrap around the edge of a person's hand such that the palm portion covers the palm of the person and the back portion covers the back of the palm of the person. A pair of finger stalls receive an index finger and a thumb. The finger stalls each have a front portion and a back portion, wherein each of the front portions are coupled to the palm portion of the panel and the back portions are coupled to the back portion. A tab portion extends from the palm portion such that the tab may be wrapped about an open edge of the hand. A securing means releasably secures the tab portion to the back portion of the panel.

Still yet another object of the present invention is to provide a new video game glove that can be adjusted to fit many sized hands.

Even still another object of the present invention is to provide a new video game glove that has a protective covering which adds comfort while allowing the fingers to move in an easy manner.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a schematic front view of a new video game glove according to the present invention.

FIG. 2 is a schematic cross-sectional view taken along line 2—2 of the present invention.

FIG. 3 is a schematic perspective view of the present invention.

DESCRIPTION OF THE PREFERRED EMBODIMENT

With reference now to the drawings, and in particular to FIGS. 1 through 3 thereof, a new video game glove embodying the principles and concepts of the present invention and generally designated by the reference numeral 10 will be described.

As best illustrated in FIGS. 1 through 3, the video game glove 10 generally comprises a panel 12. The panel has a top 14 surface and bottom surface 16, a palm portion 18, and a back portion 20. Preferably, the panel 12 is adapted to wrap around the edge of a person's hand adjacent to a thumb of the person's hand such that the palm portion 18 covers the palm of the person and the back portion 20 covers the back of the palm of the person. Ideally, the panel 12 is formed from cloth made from cotton, polyester, rayon or silk.

A pair of finger stalls 22, 24 receive an index finger and a thumb. The finger stalls 22, 24 each have a front portion 26 and a back portion 28, wherein each of the front portions 26 are coupled to the palm portion 18 of the panel and the back portions 28 are coupled to the back portion 20.

A tab portion 30 extends from the palm portion 18. The tab portion 30 is adapted to wrap about an edge of a person's hand adjacent to a person's little finger. The tab portion 30 has an upper and bottom surface corresponding to the upper 14 and bottom 16 surfaces of the panel.

Preferably, a hook and loop means 32 releasably secures the tab portion 30 to the back portion 20 of the panel 12. The hook and loop means is generally located on the bottom surface of the tab portion 30 and the top surface 14 of the back portion 20 of the panel.

Ideally, a protective covering 34 extends across the palm portion 18 of the panel and over a front side of each of the finger stalls 22, 24 including over a tip of the finger stall closer to the tab portion which is where the index finger will be inserted. The protective covering 34 is fixedly coupled to the panel 12. Preferably, the protective covering 34 is flexible and has a width generally less than one-fourth inch. The protective covering 34 is preferably made from leather, synthetic leather or an elastomeric material. The material selected must be compressible and bendable for use as a glove while gaming.

When playing video games, the thumb and index finger are the primary fingers used. The glove 10 protects these two fingers and fits many hand sizes due to the tab 30 which can be tightened and loosened depending on the width of the hand of the user. A protective covering 34 is included in the preferred embodiment in order to give additional protection to the finger and thumb of the user. The protective covering 34 also protects the palm of the user.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A glove for protecting the index finger and the thumb of a person playing a video game, said glove comprising:

a panel, said panel having a top surface and bottom surface, said panel having a palm portion, said panel having a back portion, wherein said panel is adapted to wrap around the edge of a person's hand such that said palm portion covers the palm of the person and said back portion covers the back of the palm of the person, said panel having a wrist edge adapted for positioning adjacent a wrist of the person;

a pair of finger stalls for receiving an index finger and a thumb, said finger stalls each having a front portion and a back portion, wherein each of said front portions of said finger stalls are coupled to said palm portion of said panel and said back portions of said finger stalls are coupled to said back portion of said panel;

a tab portion, said tab portion being a portion of said panel, said tab portion extending from said palm portion such that said tab may be wrapped about an open edge of said hand;

a securing means for releasably securing said tab portion to said back portion of said panel; and a protective covering, said protective covering extending from adjacent said wrist edge across said palm portion of said panel and over a front side of each of said finger stalls to a tip of each of said finger stalls, said protective covering being fixedly coupled to said panel.

2. The glove for protecting the index finger and the thumb of a person playing a video game as in claim 1, wherein said panel is formed from cloth, said cloth being made from material selected from the group consisting of cotton, polyester, rayon and silk.

3. The glove for protecting the index finger and the thumb of a person playing a video game as in claim 1, wherein said panel is adapted to wrap about an edge of a person's hand adjacent to a thumb of the person's hand;

said tab portion being adapted to wrap about an edge of a person's hand adjacent to a person's little finger.

4. The glove for protecting the index finger and the thumb of a person playing a video game as in claim 1, wherein said tab portion has a top surface and a bottom surface corresponding to said top and bottom surfaces of said panel; and wherein said securing means is a hook and loop fastener for releasably securing said tab portion to said back portion of said panel, said hook and loop fastener being generally located on said bottom surface of said tab and said top surface of said back portion of said panel.

5. The glove for protecting the index finger and the thumb of a person playing a video game as in claim 1, wherein said protective covering is flexible, said protective covering having a width generally less than one-fourth inch, said covering being selected from the group containing elastomeric material, leather and synthetic leather.

6. A glove for protecting the index finger and the thumb of a person playing a video game, said glove comprising:

a panel, said panel having a top surface and bottom surface, said panel having a palm portion, said panel having a back portion, wherein said panel is adapted to wrap around the edge of a person's hand adjacent to a thumb of the person's hand such that said palm portion covers the palm of the person and said back portion covers the back of the palm of the person, said panel having a wrist edge adapted for positioning adjacent a wrist of the person, said panel being formed from cloth, said cloth being made from material selected from the group consisting of cotton, polyester, rayon and silk;

a pair of finger stalls for receiving an index finger and a thumb, said finger stalls each having a front portion and a back portion, wherein each of said front portions of said finger stalls are coupled to said palm portion of said panel and said back portions of said finger stalls are coupled to said back portion of said panel;

a tab portion, said tab portion being a portion of said panel, said tab portion extending from said palm portion, said tab portion being adapted to wrap about an edge of a person's hand adjacent to a person's little finger, said tab portion having an upper and bottom surface corresponding to said upper and bottom surfaces of said panel;

a hook and loop means for releasably securing said tab portion to said back portion of said panel, said hook and loop means being generally located on said bottom surface of said tab and said top surface of said back portion of said panel; and a protective covering, said protective covering extending from adjacent said wrist edge across said palm portion of said panel and over a front side of each of said finger stalls to a tip of each of said finger stalls, said tip extending over a tip of the finger stall closer to said tab portion, said protective covering being fixedly coupled to said panel, said protective covering being flexible, said protective covering having a width generally less than one-fourth inch, said covering being selected from the group containing elastomeric material, leather and synthetic leather.

* * * * *